US010330035B2

(12) United States Patent
Martin et al.

(10) Patent No.: US 10,330,035 B2
(45) Date of Patent: Jun. 25, 2019

(54) METHOD AND SYSTEM FOR DETERMINING AIR-FUEL IMBALANCE

(71) Applicant: Ford Global Technologies, LLC, Dearborn, MI (US)

(72) Inventors: Douglas Raymond Martin, Canton, MI (US); Aed M. Dudar, Canton, MI (US); Robert Roy Jentz, Westland, MI (US); John Eric Rollinger, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 214 days.

(21) Appl. No.: 15/342,928

(22) Filed: Nov. 3, 2016

(65) Prior Publication Data

US 2017/0350332 A1 Dec. 7, 2017

Related U.S. Application Data

(60) Provisional application No. 62/344,777, filed on Jun. 2, 2016.

(51) Int. Cl.

| | |
|---|---|
| ***F02D 41/00*** | (2006.01) |
| ***F02D 41/14*** | (2006.01) |
| ***F02D 41/30*** | (2006.01) |
| ***F02D 41/12*** | (2006.01) |
| ***F02D 41/26*** | (2006.01) |
| ***F02D 41/24*** | (2006.01) |

(52) U.S. Cl.

CPC ..... *F02D 41/0085* (2013.01); *F02D 41/0087* (2013.01); *F02D 41/123* (2013.01); *F02D 41/1454* (2013.01); *F02D 41/1456* (2013.01); *F02D 41/1495* (2013.01); *F02D 41/2454* (2013.01); *F02D 41/26* (2013.01); *F02D 41/3005* (2013.01); *F02D 2200/1002* (2013.01)

(58) Field of Classification Search

CPC .... F02D 17/02; F02D 33/006; F02D 35/0015; F02D 35/023; F02D 41/0082; F02D 41/0085; F02D 41/0087; F02D 41/123; F02D 41/1443; F02D 41/1448; F02D 41/1454; F02D 41/1495; F02D 41/2454

See application file for complete search history.

(56) References Cited

U.S. PATENT DOCUMENTS

| | | | |
|---|---|---|---|
| 7,802,563 B2 | 9/2010 | Behr et al. | |
| 2012/0053820 A1 * | 3/2012 | Nishikiori | F02D 41/0082 701/103 |

(Continued)

OTHER PUBLICATIONS

Martin, Douglas Raymond, "Method and System for Torque Control," U.S. Appl. No. 14/746,551, filed Jun. 22, 2015, 37 pages.

*Primary Examiner* — Stephen K Cronin
*Assistant Examiner* — Anthony L Bacon
(74) *Attorney, Agent, or Firm* — Julia Voutyras; McCoy Russell, LLP

(57) ABSTRACT

Methods and systems are provided to determine air-fuel imbalance of cylinders in a variable displacement engine. In one example, the method may include during a cylinder deactivation event, sequentially deactivating each cylinder of a cylinder group including two or more cylinders and estimating a lambda deviation for each cylinder following the sequential deactivation of each cylinder of the cylinder group; and learning an air error for each cylinder based on the estimated lambda deviation.

19 Claims, 6 Drawing Sheets

(56) References Cited

U.S. PATENT DOCUMENTS

| | | | | |
|---|---|---|---|---|
| 2012/0253642 | A1* | 10/2012 | Kitano | F02D 41/0085 701/104 |
| 2016/0258375 | A1* | 9/2016 | Jammoussi | F02D 41/1475 |
| 2016/0258376 | A1* | 9/2016 | Jammoussi | F02D 41/123 |
| 2016/0333809 | A1* | 11/2016 | Jammoussi | F02D 41/1497 |
| 2017/0356354 | A1* | 12/2017 | Sakakibara | F02D 45/00 |

* cited by examiner

METHOD AND SYSTEM FOR DETERMINING AIR-FUEL IMBALANCE

CROSS REFERENCE TO RELATED APPLICATION

The present application claims priority to U.S. Provisional Patent Application No. 62/344,777 entitled "Method and System for Determining Air-Fuel Imbalance," filed on Jun. 2, 2016. The entire contents of the above-referenced application are hereby incorporated by reference in their entirety for all purposes.

FIELD

The present description relates generally to methods and systems for determining cylinder air-fuel imbalance in an internal combustion engine of a vehicle.

BACKGROUND/SUMMARY

Engine emissions compliance requires accurate detection of air-fuel imbalance between engine cylinders. Air-fuel imbalance between engine cylinders may occur due to various factors. For example, there may be cylinder-to-cylinder imbalance due to air leakages from some cylinders, exhaust gas recirculation errors, plugged intake valves, misfiring fuel injectors and faulty exhaust gas sensors. In addition to degrading emissions, air-fuel imbalances can reduce fuel efficiency and engine performance.

Cylinder-to-cylinder air-fuel imbalance may be monitored using an exhaust sensor to estimate an amount of air-fuel error by relating a sensor signal to a measured air-fuel deviation. One example approach of monitoring air-fuel variation in a multi-cylinder engine is described by Behr et al. in U.S. Pat. No. 7,802,563 B2. Therein, exhaust gas from a first group of cylinders is routed to an exhaust gas sensor, and during selected operating conditions, air-fuel imbalance is indicated in at least one of the cylinders based on a response of the exhaust gas sensor operating at or above firing frequency of cylinders in the first group. By indicating air-fuel imbalance in response to an exhaust gas sensor reading at or above firing frequency of the cylinders, feedback control interaction may be isolated to achieve a consistent indication of air-fuel error.

However, the inventors herein have recognized potential issues with such a system for air fuel imbalance detection. For example, poor or insufficient mixing of exhaust gas at an exhaust gas sensor may create discrepancies in sensor readings. As such, air-fuel error estimates made under such exhaust mixing conditions may not reflect the actual cylinder imbalance. Furthermore, exhaust system geometry may create additional issues with air-fuel imbalance learning. For example, in a multi-cylinder engine, due to stratified flow and non-uniform mixing of flow from cylinders, the flow from some cylinders may be masked from the exhaust gas sensor by the flow from other cylinders. As a result, there may be some cylinders whose flow never passes through the exhaust gas sensor. Another shortcoming may be reduced sensitivity of the exhaust gas sensor during certain engine operating conditions. For example, during cold-start conditions, the exhaust gas sensor may not be sufficiently warmed up and may register sensor readings with discrepancies, affecting cylinder air-fuel imbalance learning.

In alternate approaches, the air-fuel imbalance may be learned using in-cylinder pressure or torque errors. However such sensors may be expensive. Still other approaches rely on exhaust pressure sensors. However, such sensors may be unreliable especially when the pressure is measured in the exhaust manifold further downstream from the cylinder output. Still other approaches may intrusively drive engine cylinders very lean or very rich to identify the imbalance. However, such intrusive approaches can result in excessive emissions.

In one example, the shortcomings described above may be at least partly addressed by a method for an engine that comprises: during a cylinder deactivation event, sequentially deactivating each cylinder of a cylinder group including two or more cylinders; estimating a lambda deviation for each cylinder following the sequential deactivation of each cylinder of the cylinder group; and learning an air error for each cylinder based on the estimated lambda deviation. In this way, the air error in cylinders of a multi-cylinder engine may be reliably and opportunistically identified while accounting for discrepancies created by exhaust geometry, sensor sensitivity and exhaust mixing.

As one example, an engine may include a plurality of cylinders located in a first and a second cylinder bank. During conditions when the engine load is low, one or more cylinders, such as all cylinders of one cylinder bank, may be selectively deactivated (e.g., fuel and spark may be deactivated) while the remaining active cylinders are operated with a higher average load to reduce engine pumping losses and improve fuel economy. Prior to cylinder deactivation, an air-fuel ratio with all cylinders firing may be noted. During the cylinder deactivation event, the cylinders to be deactivated may be sequentially deactivated and a lambda deviation (from the air-fuel ratio with all cylinders firing) for each cylinder following the sequential deactivation may be determined. Since the deactivated cylinder is not receiving fuel, any lambda deviation is attributed to air flowing through the cylinder. In this way, the air error for each cylinder may be learned. Additionally, the lambda deviation may be compared to an expected lambda deviation to learn an air error for each cylinder. An order of cylinder deactivation may be adjusted so that the air error for each engine cylinder can be learned during the deactivation event. The learned air errors can then be used to determine an air-fuel imbalance between cylinders. By learning the air error in each cylinder of the first and second cylinder bank based on the estimated lambda deviation, issues related to exhaust geometry, sensor sensitivity and exhaust mixing may be addressed.

The approach described here may confer several advantages. For example, the method provides improved learning of air-fuel imbalance between cylinders of a multi-cylinder engine. By deactivating each cylinder of a cylinder group opportunistically during a cylinder deactivation mode of engine operation while the remaining engine cylinders are active, individual cylinder air errors may be learned independent of exhaust manifold geometry, and even in the presence of non-uniform cylinder flow. Furthermore, cylinder imbalance can be reliably determined using an existing exhaust sensor. By learning the air-fuel imbalance between cylinders, engine operation can be adjusted to account for and/or compensate for said imbalance. As such, by reducing cylinder-to-cylinder air-fuel variations in an engine, exhaust emissions may be reduced and fuel efficiency may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 5:
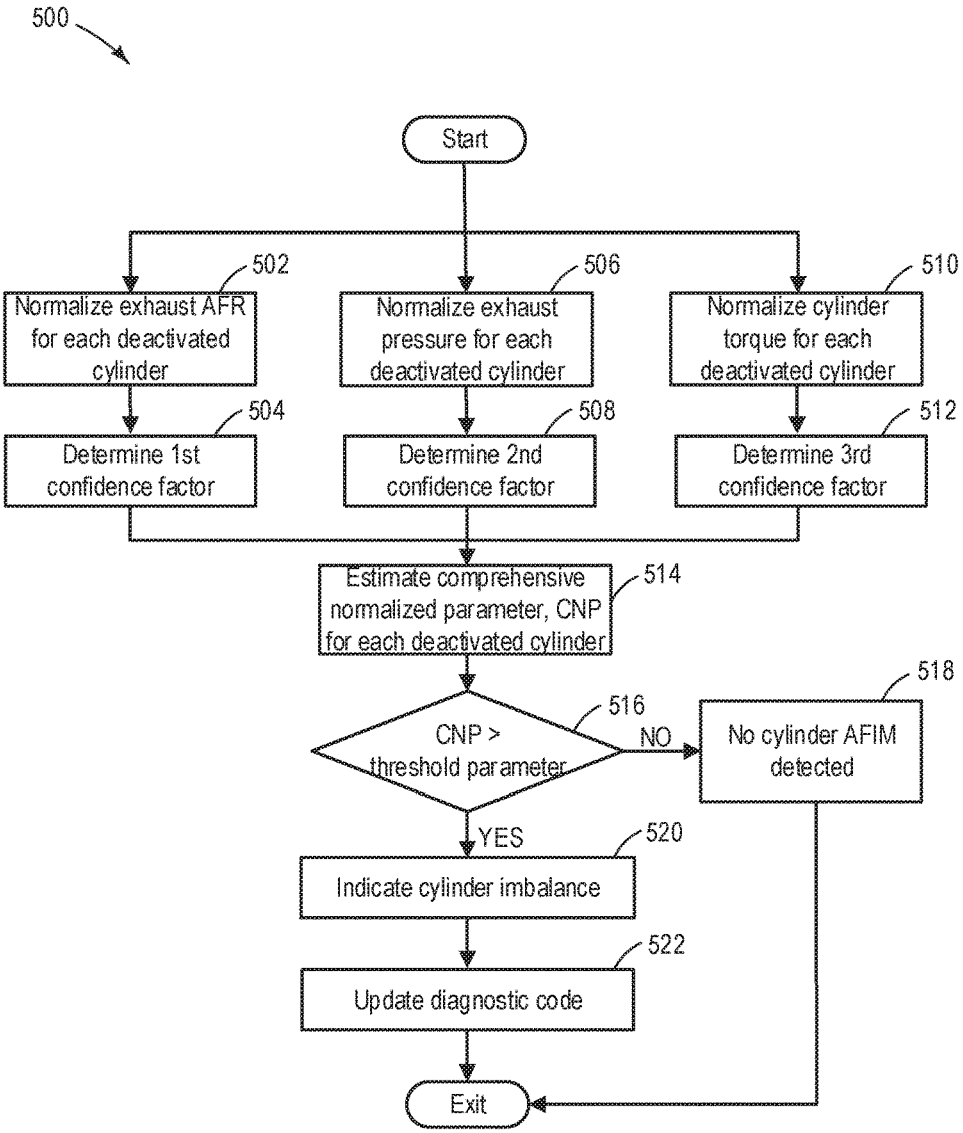
FIG. 5 shows a flow chart for an example method of identifying cylinder air-fuel imbalance based on a composite index estimated using air-fuel ratio, exhaust pressure and cylinder torque.
Figure 6:
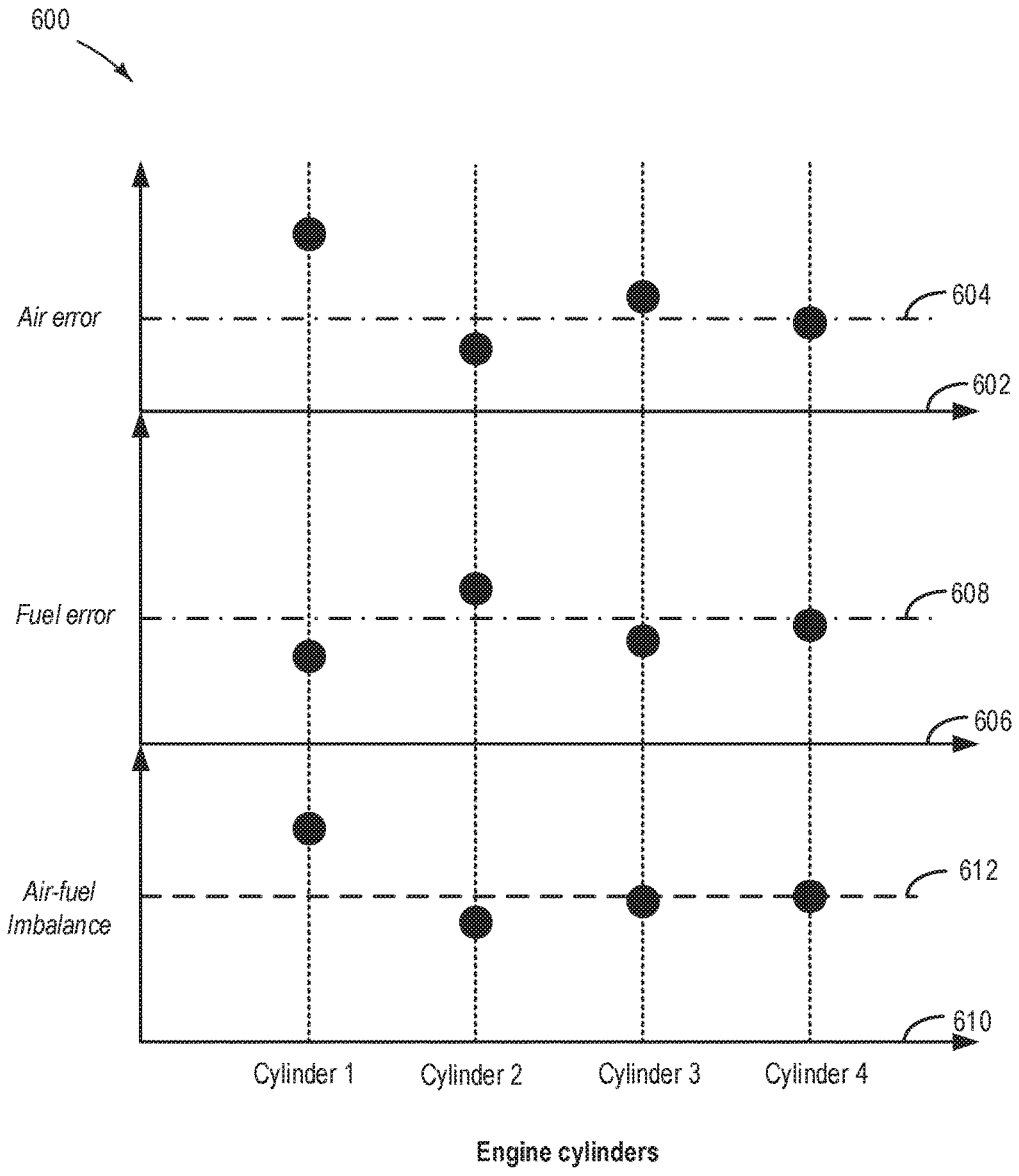
FIG. 6 shows an example graphical output for identifying cylinder imbalance based on air error, fuel error and air-fuel error.

The following description relates to systems and methods for identifying cylinder-to-cylinder imbalance in a vehicle engine operating with variable displacement. As such, the variable displacement engine (VDE), such as the engine depicted in FIGS. 1-2, can switch between operation with all cylinders firing or some of the cylinders firing by selectively deactivating fuel and spark and changing the operation of the intake and exhaust valves of selected cylinders. FIG. 2 shows a partial view of a single cylinder in a multi-cylinder engine system. An engine controller may be configured to perform a routine, such as the example routine of FIGS. 3-4 for opportunistically estimating cylinder-to-cylinder air-fuel imbalance parameters during a VDE mode of operation of a variable displacement engine. FIG. 5 shows an example routine that may be used by the controller for identifying cylinder-to-cylinder air-fuel imbalance based on a composite index determined by weighting air-fuel ratio based imbalance with a first confidence factor, exhaust pressure based imbalance with a second confidence factor, and cylinder torque based imbalance with a third confidence factor. FIG. 6 shows an example graphical output for identifying cylinder imbalance based on air error, fuel error and air-fuel error in cylinders of a multi-cylinder engine.

Figure 1:
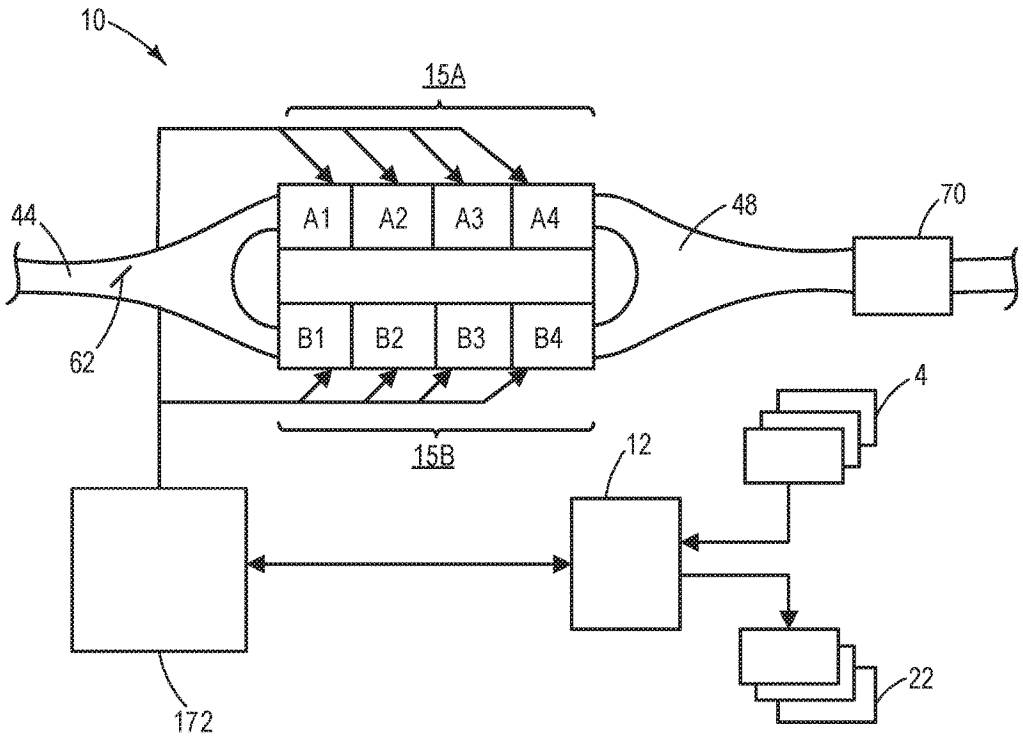
FIG. 1 shows an example exhaust system layout of a variable displacement engine (VDE).
Figure 2:
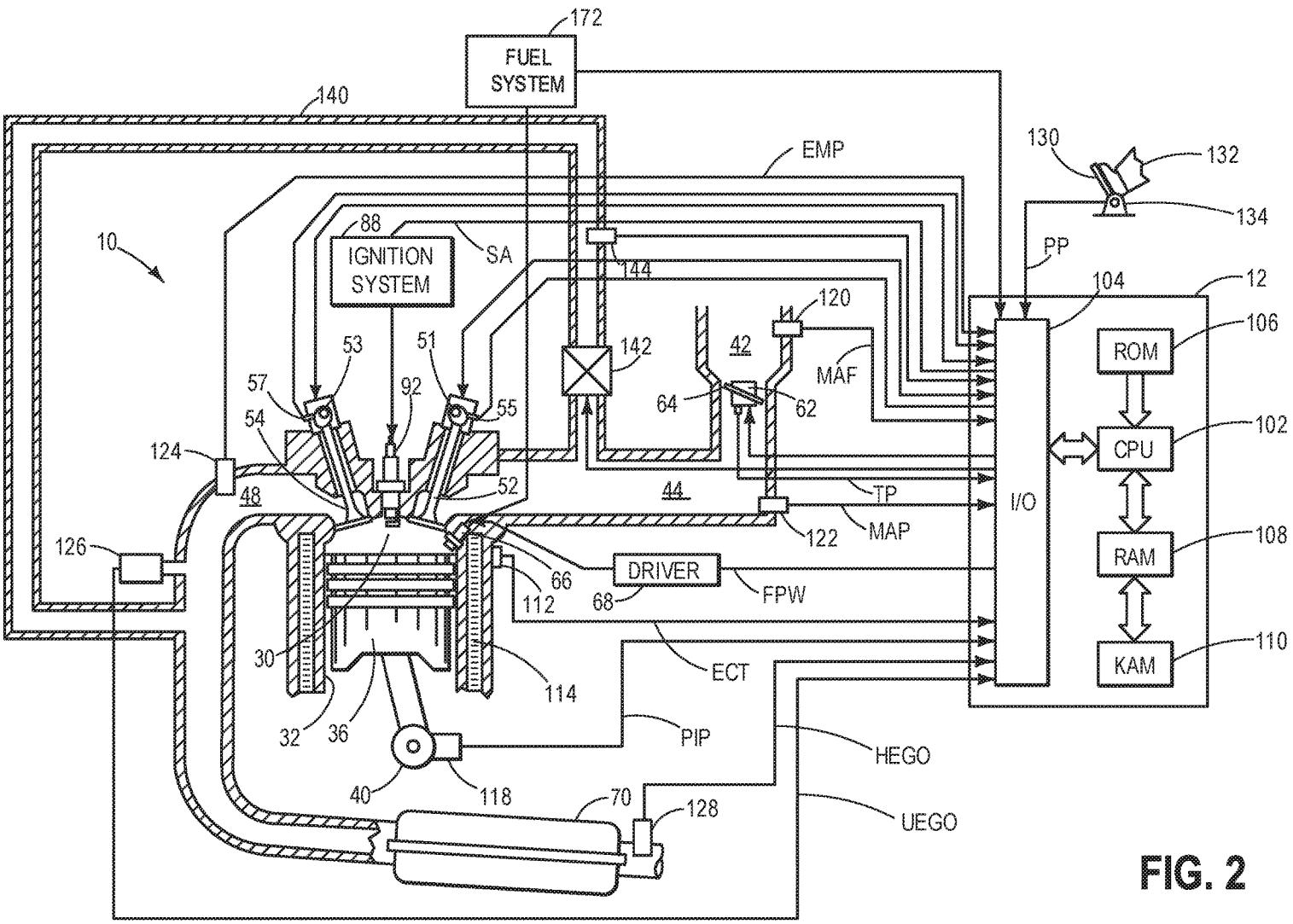
FIG. 2 shows a partial view of an internal combustion engine.

FIG. 1 shows an example variable displacement engine (VDE) 10, in which cylinders (e.g., cylinders A1-A4 in cylinder bank 15A and cylinders B1-B4 in cylinder bank 15B) may have cylinder valves held closed during one or more engine cycles. The cylinder valves may be deactivated via hydraulically actuated lifters, or via a cam profile switching (CPS) mechanism in which a cam lobe with no lift is used for deactivated valves. Other mechanisms for valve deactivation may also be used. As depicted herein, engine 10 is a V8 engine with two cylinder banks 15A and 15B (each cylinder bank containing four cylinders) having an intake manifold 44 (with throttle 62) and an exhaust manifold 48 coupled to an emission control device 70 including one or more catalysts and exhaust gas sensors.

During selected conditions, such as when the full torque capability of the engine is not needed, one or more cylinders in a first cylinder group and a second cylinder group may be selected for deactivation (herein also referred to as a VDE mode of operation). Specifically, one or more cylinders of the selected group of cylinders may be deactivated by shutting off respective fuel injectors while maintaining operation of the intake and exhaust valves such that air may continue to be pumped through the cylinders. While fuel injectors of the disabled cylinders are turned off, the remaining enabled cylinders continue to carry out combustion with fuel injectors active and operating. To meet the torque requirements, the engine produces the same amount of torque on those cylinders for which the injectors remain enabled. In other words, the remaining active cylinders are operated at higher average cylinder loads. This requires higher manifold pressures, resulting in lowered pumping losses and increased engine efficiency. Also, the lower effective surface area (from only the enabled cylinders) exposed to combustion reduces engine heat losses, improving the thermal efficiency of the engine.

Based on a drop in torque demand, one or more cylinders may be selectively deactivated. Further, cylinders may be grouped for deactivation based on their position along the engine block, on an engine bank, as well as their deactivation history. As one example, cylinders from the different cylinder banks (e.g., cylinder banks 15A and 15B) may be grouped together for deactivation. For example, during a first VDE condition, cylinders A1, B1, A4 and B4 may be deactivated while during a second VDE condition, cylinders A2, B2, A3 and B3 may be deactivated. In an alternate example, the first VDE pattern may contain a different identity and number cylinders than the second VDE pattern.

Engine 10 may operate on a plurality of substances, which may be delivered via fuel system 172. Engine 10 may be controlled at least partially by a control system including controller 12. Controller 12 may receive various signals from sensors 4 coupled to engine 10, and send control signals to various actuators 22 coupled to the engine and/or vehicle. In addition, controller 12 may receive an indication of cylinder knock or pre-ignition from one or more knock sensors distributed along the engine block. When included, the plurality of knock sensors may be distributed symmetrically or asymmetrically along the engine block. Further, the one or more knock sensors may include accelerometers, ionization sensors or in cylinder pressure transducers.

FIG. 2 depicts a schematic diagram of one cylinder of engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal (PP). Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Crankshaft 40 may also be coupled to a starter motor via a flywheel to enable a starting operation of engine 10. Further, a crankshaft torque sensor may be coupled to crankshaft 40 for monitoring cylinder torque. In one example, the torque sensor may be a laser torque sensor or a magnetic torque sensor. Still other torque sensors may be used. The cylinder torque may be estimated using measured position signals from the torque sensor. Still other methods may be used to estimate cylinder torque. As elaborated in FIGS. 4-5, an engine controller may infer cylinder air-fuel imbalance based on the output of the torque sensor.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two more exhaust valves. In this example, intake valve 52 and exhaust valve 54 may be controlled by cam actuation via one or more cams and may utilize one or more of cam profile switching (CPS), variable cam timing (VCT), variable valve timing (VVT), and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

In some embodiments, each cylinder of engine 10 may be configured with one or more fuel injectors for providing fuel thereto. As a non-limiting example, cylinder 30 is shown including one fuel injector 66, which is supplied fuel from fuel system 172. Fuel injector 66 is shown coupled directly to cylinder 30 for injecting fuel directly therein in proportion to the pulse width of signal FPW received from controller 12 via electronic driver 68. In this manner, fuel injector 66 provides what is known as direct injection (hereafter also referred to as "DI") of fuel into combustion cylinder 30.

It will be appreciated that in an alternate embodiment, injector 66 may be a port injector providing fuel into the intake port upstream of cylinder 30. It will also be appreciated that cylinder 30 may receive fuel from a plurality of injectors, such as a plurality of port injectors, a plurality of direct injectors, or a combination thereof.

Continuing with FIG. 2, intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow (MAF) sensor 120 and a manifold air pressure (MAP) sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

A pressure sensor 124 may be coupled to exhaust passage 48 downstream of exhaust valve 54 and upstream of emission control device 70. Pressure sensor 124 is preferably positioned close to exhaust valve 54 to measure the exhaust manifold pressure (EMP). In one embodiment, pressure sensor may be a pressure transducer. As elaborated at FIGS. 4-5, an engine controller may infer cylinder air-fuel imbalance based on the output of the pressure sensor.

An upstream exhaust gas sensor 126 is shown coupled to exhaust passage 48 upstream of emission control device 70. Upstream sensor 126 may be any suitable sensor for providing an indication of exhaust gas air-fuel ratio such as a linear wideband oxygen sensor or a universal exhaust gas oxygen (UEGO) sensor, a two-state narrowband oxygen sensor or EGO, a heated exhaust gas oxygen (HEGO) sensor. In one embodiment, upstream exhaust gas sensor 126 is a UEGO sensor configured to provide output, such as a voltage signal, that is proportional to the amount of oxygen present in the exhaust. Controller 12 uses the output to determine the exhaust gas air-fuel ratio. As elaborated at FIGS. 4-5, an engine controller may infer cylinder air-fuel imbalance based on output of the exhaust gas sensor.

Emission control device 70 is shown arranged along exhaust passage 48 downstream of exhaust gas sensor 126. Device 70 may be a three way catalyst (TWC), configured to reduce NOx and oxidize CO and unburnt hydrocarbons. In some embodiments, device 70 may be a NOx trap, various other emission control devices, or combinations thereof.

A second, downstream exhaust gas sensor 128 is shown coupled to exhaust passage 48 downstream of emissions control device 70. Downstream sensor 128 may be any suitable sensor for providing an indication of exhaust gas air-fuel ratio such as a UEGO, EGO, HEGO, etc. In one embodiment, downstream sensor 128 is a HEGO sensor configured to indicate the relative enrichment or enleanment of the exhaust gas after passing through the catalyst. As such, the HEGO sensor may provide output in the form of a switch point, or the voltage signal at the point at which the exhaust gas switches from lean to rich.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor 144 may be arranged within the EGR passage and may provide an indication of one or more of pressure, temperature, and concentration of the exhaust gas. Under some conditions, the EGR system may be used to regulate the temperature of the air and fuel mixture within the combustion chamber.

Controller 12 is shown in FIG. 2 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; exhaust manifold pressure (EMP) from pressure sensor 124; engine coolant temperature (ECT) from temperature sensor 112 coupled to cooling sleeve 114; a profile ignition pickup signal (PIP) from Hall effect sensor 118 (or other type) coupled to crankshaft 40; a cylinder torque from the crankshaft torque sensor coupled to crankshaft 40; throttle position (TP) from a throttle position sensor; and absolute manifold pressure (MAP) signal from sensor 122. Engine speed signal, RPM, may be generated by controller 12 from signal PIP. Controller 12 also may employ the various actuators of FIG. 2 to adjust engine operation based on the received signals and instructions stored on a memory of the controller.

Storage medium read-only memory 106 can be programmed with computer readable data representing non-transitory instructions executable by processor 102 for performing the methods described below as well as other variants that are anticipated but not specifically listed.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

As described above, FIG. 2 shows only one cylinder of a multi-cylinder engine, and each cylinder may similarly include its own set of intake/exhaust valves, fuel injector, spark plug, etc.

Figure 3:
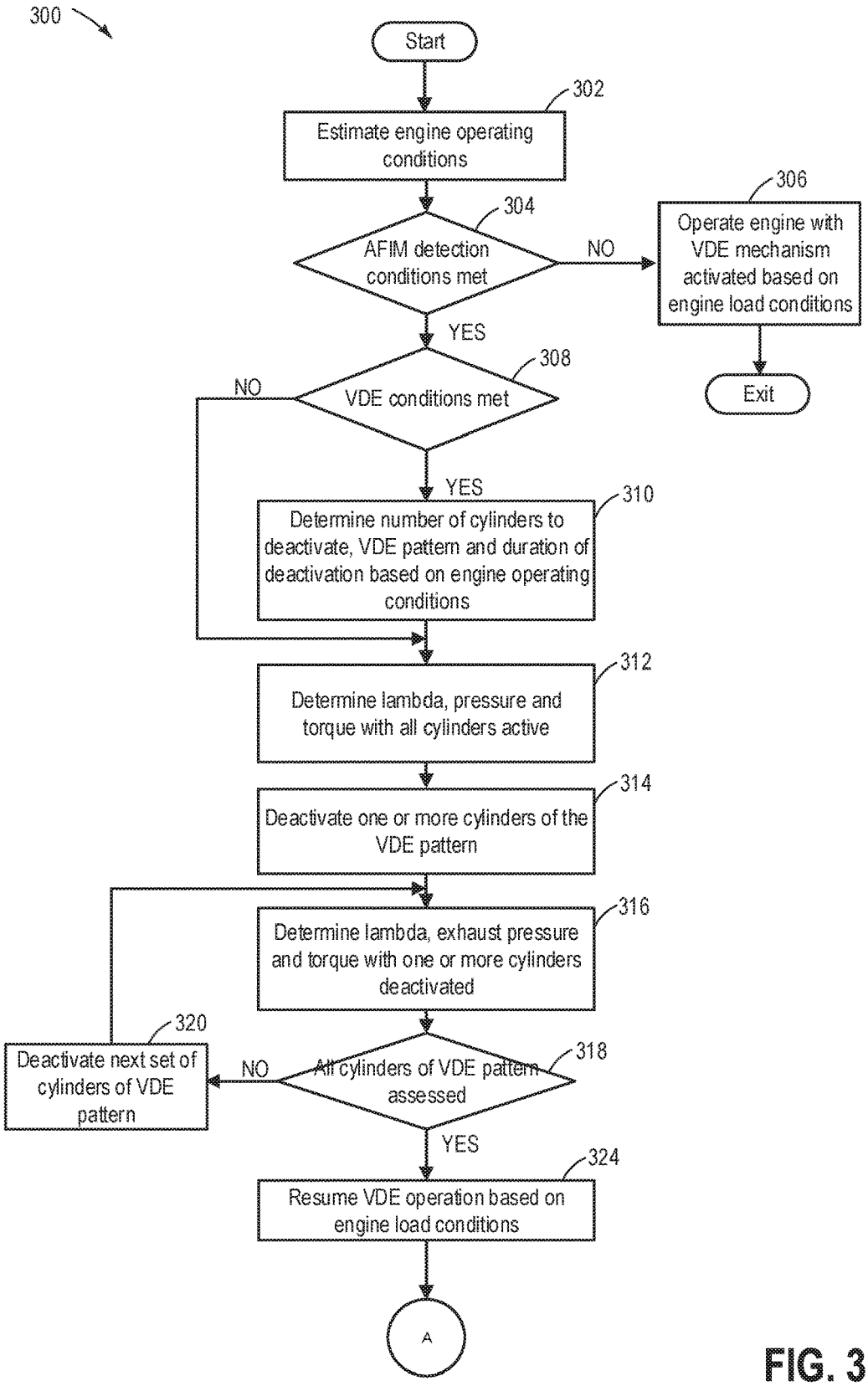
FIG. 3 shows a flow chart for an example method of estimating cylinder-to-cylinder air-fuel imbalance parameters opportunistically during a VDE mode of engine operation.

Referring to FIG. 3, an example method 300 for identifying cylinder air-fuel imbalance in a variable displacement engine is shown. Instructions for carrying out method 300 and the rest of the methods included herein may be executed by controller 12 based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, method 300 includes determining, estimating, and/or measuring current engine operating conditions. The operating conditions may include but are not limited to an engine speed-load, torque demand, boost pressure, manifold air pressure, engine temperature, combustion air-fuel ratio, exhaust pressure, and engine temperature. Method 300 proceeds to 304 after engine operating conditions are determined.

At 304, method 300 determines if one or more air-fuel imbalance detection (AFIM) conditions are met. The AFIM detection conditions may include a threshold duration or distance of vehicle travel having elapsed since a last AFIM detection. As another example, AFIM detection may be performed once every drive cycle. If AFIM conditions are not met, the method 300 proceeds to 306 to operate the engine with the variable displacement engine (VDE) mechanism activated based at least on driver demand. In particular, the engine may be operated in a VDE mode with one or more cylinders deactivated when the driver demand is lower, and operated in a non-VDE mode with all cylinders active when the driver demand is higher. The method may then exit. If one or more AFIM conditions are met, the answer is YES and method 300 proceeds to 308.

At 308, the method 300 determines if VDE conditions are met. VDE conditions may be met if the driver demand is lower than a threshold. If VDE conditions are met, the method proceeds to 310. At 310, the method 300 may include determining a number of cylinders to deactivate based on the drop in driver demand, the number increased as the driver demanded torque decreases. In addition, an identity of cylinders to be deactivated may be determined. In one example, the controller may select an initial VDE pattern for cylinder deactivation and duration of cylinder deactivation based on current engine operating conditions. As elaborated herein, the initial VDE pattern may be adjusted responsive to the AFIM detection conditions being met so as to learn air errors for each cylinder and thereby learn a cylinder-to-cylinder air-fuel imbalance opportunistically during the VDE mode. Method 300 may then proceed to 312. Returning to 308, if VDE conditions are not met, the answer is NO and method 300 proceeds to 312 to intrusively learn cylinder air errors and cylinder-to-cylinder air-fuel imbalance.

At 312, the method 300 may include estimating an exhaust air-fuel ratio (or lambda value), an exhaust pressure, and individual cylinder torque values with all cylinders active. For example, the air-fuel ratio may be measured at an exhaust sensor (e.g., exhaust sensors 126 and/or 128 at FIG. 2). The controller may determine an average lambda (LAM_ALL) over an engine cycle (2 revolutions) with all cylinders active. The exhaust pressure may be measured at an exhaust pressure sensor (e.g., pressure sensor 124 at FIG. 2) and individual cylinder torque may be measured at a crankshaft torque sensor (such as torque sensor coupled to a crankshaft 40 of each cylinder, as shown in FIG. 2).

After determining the air-fuel ratio, exhaust pressure, and cylinder torque with all cylinders active, method 300 proceeds to 314. At 314, one or more cylinders corresponding to the VDE pattern may be deactivated. In one example, a first cylinder is deactivated. For example, one cylinder of the selected VDE pattern may be deactivated while the remaining engine cylinders are maintained active. The deactivation may include turning off a fuel injector of and spark to the selected cylinder while continuing to open or close intake and exhaust valves of the cylinder so as to pump air through the selected cylinder. While the fuel injector of the deactivated cylinder is turned off, the remaining enabled cylinders continue to carry out combustion with fuel injectors active and operating. For example, an engine may have two cylinder banks, each cylinder bank containing four cylinders (e.g., cylinders A1-A4 in cylinder bank 15A and cylinders B1-B4 in cylinder bank 15B at FIG. 1). In one example, the selected VDE pattern may include cylinders listed according to a firing order (e.g., cylinders A1, B1, A4, B4, B3, A2, B2 and A3), each cylinder may be selectively deactivated, one at a time while the remaining engine cylinders are active. By deactivating one cylinder at a time, any air errors may be attributed to the deactivated cylinder. It will be appreciated that while the above example suggests sequentially deactivating one cylinder at a time to learn the air-fuel imbalance of the cylinder, in alternate examples, a plurality of cylinders (e.g., two or more) of the selected VDE pattern may be deactivated concurrently. In such as case, a more complex calculation may be required for the determination of air-fuel imbalance of each cylinder, and to differentiate the air errors associated with each deactivated cylinder.

After selecting one or more cylinders of the selected VDE pattern for deactivation, method 300 proceeds to 316. At 316, an air-fuel ratio/lambda, exhaust pressure and cylinder torque may be determined, estimated and/or measured while the single (or one or more) cylinder(s) of the VDE pattern is deactivated and remaining cylinders are active. For example, the controller may disable one cylinder at a time using the VDE mechanism and capture the lambda over an engine cycle for each cylinder's deactivation (e.g., LAM_1 for cylinder 1, LAM_2 for cylinder 2, LAM_8 for cylinder 8 in an 8 cylinder engine). Upon determining lambda, exhaust pressure and cylinder torque with one or more cylinders of the selected VDE pattern deactivated, method 300 proceeds to 318. At 318, the method 300 judges if values of lambda, exhaust pressure and cylinder torque have been determined for all cylinders of the selected VDE pattern. If the answer is NO, routine proceeds to 320. At 320, the routine reactivates the previous selectively deactivated cylinder(s) and deactivates the next cylinder (or set of cylinders) of the selected VDE pattern and returns to 316 to determine lambda, exhaust pressure and cylinder torque values for the deactivated cylinders while remaining cylinders are held active. For example, if the previous cylinder selected for deactivation was A1, the next cylinder selected for deactivation may be B1. As another example, if the previous cylinders selected for deactivation were A1 and A3, the next cylinders selected for deactivation may be B1 and B3. The lambda, exhaust pressure and cylinder torque values are determined while cylinders B1 (or B1 and B3) are deactivated and the remaining cylinders are active.

In one example, the cylinders to be deactivated according to the selected cylinder pattern may each be sequentially deactivated. Then, the cylinders may be reactivated and the remaining cylinders may be sequentially deactivated, thereby allowing all engine cylinders to have been deactivated at least once during the VDE mode AFIM detection. In one example, the engine is a four cylinder engine (with cylinders 1-4) and responsive to the drop in driver demand, one cylinder is to be deactivated during the VDE mode. Cylinder 1 may have been originally selected to be deactivated during the entirety of the VDE mode. However, during the VDE mode AFIM detection, cylinder 1 may be deactivated and an air error of Cylinder 1 may be learned. Then, while VDE conditions are still present, Cylinder 1 may be reactivated and Cylinder 2 may be deactivated and an air error of Cylinder 2 may be learned. Then, Cylinder 2 may be reactivated and Cylinder 3 may be deactivated and an air error of Cylinder 3 may be learned. Finally Cylinder 3 may be reactivated and Cylinder 4 may be deactivated and an air error of Cylinder 4 may be learned. In this way, during the VDE mode, cylinders may be sequentially deactivated until an air error of each cylinder of the engine is opportunistically learned during the VDE mode.

Returning to 318, if lambda, exhaust pressure and cylinder torque values of all cylinders have been assessed, then the routine proceeds to 324. At 324, the engine resumes VDE operation based on current engine load conditions. This includes maintaining one or more cylinders deactivated if VDE conditions are still present. Else if cylinder reactivation conditions are met, the deactivated cylinders are reactivated. The method 300 then proceeds to 402 of method 400 to determine air-fuel imbalance between cylinders. As elaborated at FIG. 4, the controller may calculate the difference in lambda for each cylinder from the all-cylinder value, and use this difference relative to a threshold to determine if there is a cylinder imbalance. The controller may assess cylinder specific torque and exhaust pressure estimates in a similar manner. If imbalance is detected, a diagnostic code (DTC) may be set.

It will be appreciated that while the method of FIG. 3 estimates an air-fuel imbalance between cylinders during a VDE mode by sequentially deactivating engine cylinders and learning a corresponding lambda deviation (from a value with all cylinders firing), in further examples, the learning may also be performed during idle engine conditions and medium load conditions with a transmission in gear and a torque converter coupled between the engine and the transmission locked. This may further enhance the likelihood that a cylinder's flow will be captured at the downstream exhaust gas sensor since the flow pattern is likely to change at higher flows (at medium load conditions) as compared to lower flows (at idle conditions). By comparing the cylinder specific lambda deviation from a value with all cylinders firing learned by sequentially deactivating cylinders during VDE conditions relative to idle conditions and mid load conditions, air-fuel imbalances resulting from cylinder specific air errors may be learned more reliably. In addition, a robustness of the imbalance detection is enhanced. For example, false detections and missed detections of imbalance are reduced.

Figure 4:
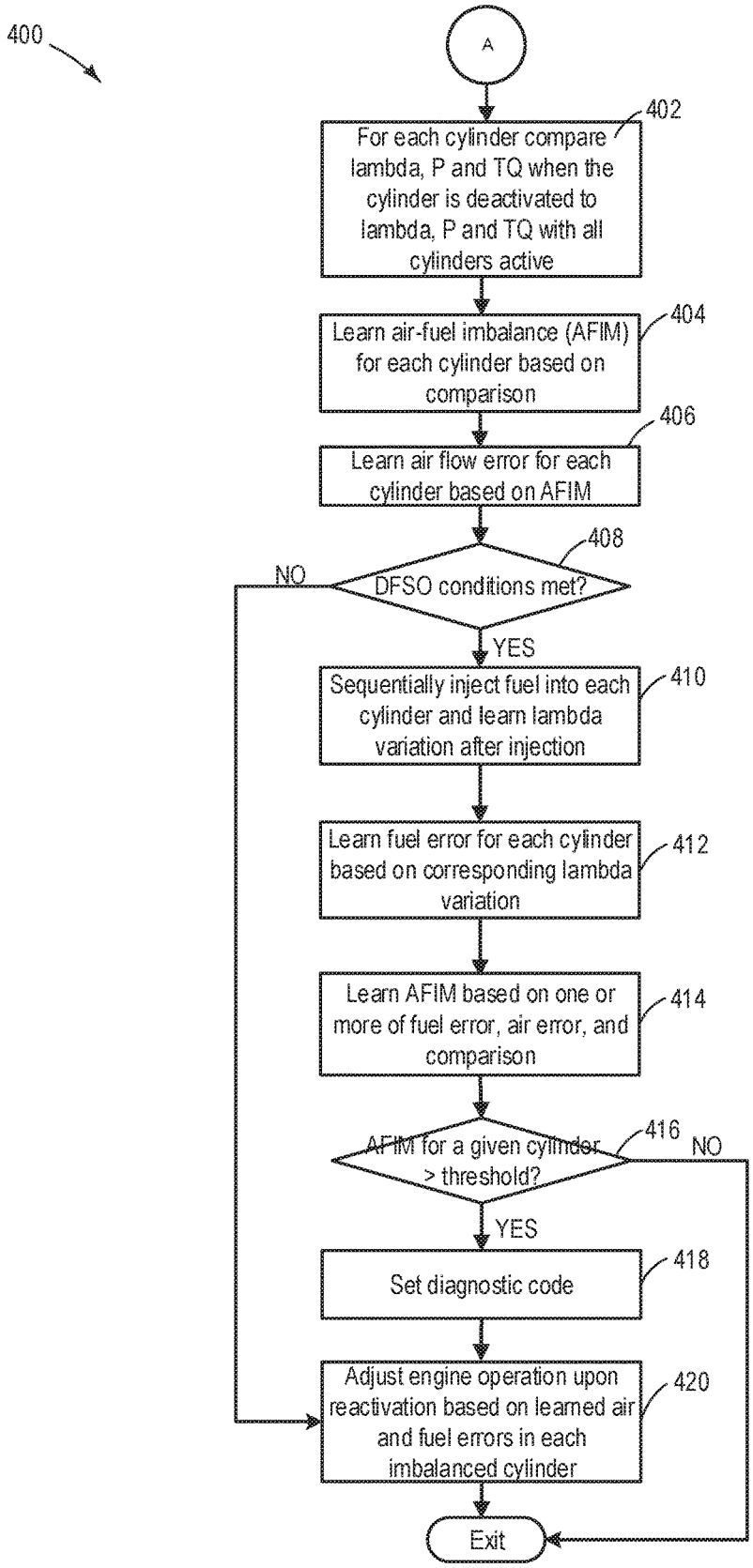
FIG. 4 shows a flow chart for an example method of identifying cylinder-to-cylinder air-fuel imbalance.

FIG. 4 illustrates an example method 400 for learning air-fuel imbalance between cylinders in a multi-cylinder engine. Method 400 will be described herein with reference to components and systems depicted in FIGS. 1-2, particularly, regarding engine 10, cylinder banks 15A and 15B, and controller 12. Method 400 may be carried out by the controller executing computer-readable media stored thereon. It should be understood that the method 400 may be applied to other engine systems of a different configuration without departing from the scope of this disclosure.

The approach described herein senses changes in output of each of an exhaust gas sensor, pressure sensor, and torque sensor correlated to combustion events in cylinders that are sequentially deactivated during air-fuel imbalance learning. The exhaust gas sensor outputs a signal that is proportionate to oxygen concentration in the exhaust. The pressure sensor outputs a signal that is proportionate to the exhaust pressure while the torque sensor outputs a signal that corresponds to the torque exerted on the cylinders during combustion.

By deactivating a single cylinder of the selected VDE pattern, while the remaining engine cylinders may be combusting air and fuel, the outputs of the exhaust sensor, pressure sensor and torque sensor may be used to indicate cylinder air-fuel imbalance for the deactivated cylinder. Thus, the present approach may increase a signal to noise ratio for determining cylinder air-fuel imbalance. In one example, a UEGO or a HEGO sensor output voltage (converted to air-fuel ratio or lambda (e.g., difference between air-fuel and air-fuel stoichiometric)) is sampled for cylinders firing after exhaust valves of the cylinders receiving fuel are opened while the single cylinder of the selected VDE pattern is deactivated. The sampled oxygen sensor signal is then evaluated to determine a lambda value or air-fuel ratio. In another example, the pressure sensor output is sampled to determine exhaust pressure and the torque output is sampled to determine cylinder torque for cylinders firing after exhaust valves of the cylinders receiving fuel are opened while the single cylinder of the selected VDE pattern is deactivated.

Method 400 begins at 402 where air-fuel ratio/lambda, exhaust pressure (P) and cylinder torque (TQ) values for each deactivated cylinder (n) of the selected VDE pattern is compared with average values of lambda (LAMavg), exhaust pressure (Pavg) and cylinder torque (TQavg) when all cylinders are active. Specifically, the comparison may include calculating a lambda difference ($LAM_diff_n$), pressure difference ($P_diff_n$) and cylinder torque difference ($TQ_diff_n$) for each deactivated cylinder of the selected VDE pattern as shown in the equations below.

$$LAM_diff_n = LAMavg - LAM_n \quad \text{(Eq. 1)}$$

$$P_diff_n = Pavg - P_n \quad \text{(Eq. 2)}$$

$$TQ_diff_n = TQavg - TQ_n \quad \text{(Eq. 3)}$$

After comparing the lambda, exhaust pressure and cylinder torque values for each deactivated cylinder with the average values of lambda, exhaust pressure and cylinder torque when all cylinders are active, method 400 proceeds to 404.

At 404, the differences in lambda, exhaust pressure and cylinder torque are used to learn a torque error for each cylinder. For example, a first air error (resulting in a corresponding first torque error) may be determined for a given cylinder based on the lambda deviation following deactivation of said cylinder relative to the lambda with all cylinders firing. As another example, a second torque error may be determined for said cylinder based on the exhaust pressure deviation following deactivation of said cylinder relative to the exhaust pressure with all cylinders firing. As yet another example, a third torque error may be determined for said cylinder based on the crankshaft speed following deactivation of said cylinder relative to the crankshaft speed with all cylinders firing. The first, second, and third errors may then be compared to each other to determine an average error for said cylinder. The same steps may then be repeated to learn the error for each engine cylinder.

In another example, the differences in lambda, exhaust pressure and cylinder torque may be compared with threshold values to identify presence of cylinder air/torque error and a corresponding air-fuel/torque imbalance between cylinders. Specifically, the lambda difference for each deactivated cylinder of the selected VDE pattern is compared to a threshold lambda difference, wherein the threshold lambda difference is based on an imbalance that produces either excessive emissions (e.g., higher than a threshold level of emissions) or produces unacceptable vibration (e.g., higher than a threshold level of vibrations). For example, if the lambda difference is greater than the threshold lambda difference, an air-fuel imbalance may be indicated for the deactivated cylinder under consideration. Otherwise, if the lambda difference is less than the threshold lambda difference, no cylinder air-fuel imbalance is detected for each selected cylinder of the selected VDE pattern. Likewise, the exhaust pressure difference for the deactivated cylinder of the selected VDE pattern is compared to a threshold pressure difference, wherein the threshold pressure based on a pressure imbalance that either produces excessive emissions or produces unacceptable vibration. If the exhaust pressure difference is greater than the threshold pressure difference, an air-fuel imbalance may be indicated for the deactivated cylinder. Otherwise, if the exhaust pressure difference is less than the threshold pressure difference, no cylinder air-fuel imbalance is detected for the deactivated cylinder. In yet another example, the cylinder torque difference for the deactivated cylinder of the selected VDE pattern is compared to a threshold torque difference, wherein the threshold torque difference is based on a torque imbalance that either produces excessive emissions or produces unacceptable vibration. If the cylinder torque difference is greater than the threshold torque difference, an air-fuel imbalance may be indicated for the deactivated cylinder under consideration. Otherwise, if the cylinder torque difference is less than the threshold torque difference, no cylinder air-fuel imbalance is detected for the deactivated cylinder.

The choice of a parameter (that is, one or more of lambda, exhaust pressure and cylinder torque differences) used for learning cylinder air-fuel imbalance may be selected based on reliability of an estimate of the difference parameter as determined based on operating conditions. For example, when the exhaust gas is sufficiently mixed and/or the exhaust gas sensor is sufficiently warmed up, the lambda difference may be used to learn air-fuel imbalance of the deactivated cylinder with improved reliability. In another example, during a cold-start condition, exhaust gas temperature may be lower than a threshold temperature and the exhaust gas sensor is not sufficiently warmed up. As such, the lambda difference estimated under such conditions may not be reliable or accurate. Therefore, a separate parameter other than the lambda difference, such as the exhaust pressure difference or the cylinder torque difference may be weighted higher during cold-start conditions to learn air-fuel imbalance under for the deactivated cylinder of the selected VDE pattern. In this way, air-fuel imbalance learning of the deactivated cylinder may be improved.

Upon determining air-fuel imbalance based on difference parameters for each deactivated cylinder of the selected VDE, method 400 proceeds to 404. At 404, an air-fuel imbalance (or torque deviation) for each engine cylinder is learned based on the differences. For example, the imbalance for each cylinder may be determined based on the first, second, and third errors learned based on lambda deviation, exhaust pressure deviation, and crankshaft acceleration, respectively.

At 406, an air flow error for each cylinder of the engine is learned based on the corresponding lambda deviation. In particular, since the lambda deviation is learned when a single cylinder is selectively deactivated, the error is attributed to air error since no fueling is occurring at that time. In this way, an air error component of the air-fuel imbalance for a cylinder can be differentiated from a fuel error component of the air-fuel imbalance.

At 408, the routine judges if decelerated fuel shut-off (DFSO) conditions are present. DFSO conditions may include one or more of an accelerator pedal not being depressed, a constant or decreasing vehicle speed, and a brake pedal being depressed.

Returning to 408, if DFSO conditions are met, the routine proceeds to 410 to learn a fuel error for fuel injectors of each engine cylinder. Otherwise, if the DFSO conditions are not met the routine proceeds to 420.

Next at 410, to learn the fuel injector error for each cylinder, a predetermined amount of fuel is sequentially injected into each cylinder and the air-fuel mixture is combusted. In one example, injecting an amount of fuel includes injecting a fixed amount of fuel into a selected cylinder while maintaining the remaining cylinders deactivated (e.g., no fuel injected) while the engine continues to rotate. After injecting fuel in the selected cylinder, the cylinder may be fired one or more times to produce a perturbation of exhaust air-fuel ratio or lambda value after combustion products are exhausted after each combustion event in the firing cylinder. The air-fuel ratio or lambda value may be correlated to the amount of fuel injected to the cylinder, and the amount of fuel injected to the cylinder may be provided by adjusting a fuel pulse width applied to a fuel injector of the cylinder receiving fuel. After lambda values are determined, it is judged whether or not a lambda variation is present. In particular, a deviation of the lambda following injection from a maximum lean air-fuel ratio during the DFSO may be estimated and compared to an expected lambda (based on the injected amount of fuel). The actual lambda value of a cylinder may differ from the expected lambda value due to a fuel injector error of the cylinder which is then learned.

Next at 412, the routine may learn a fueling error associated with the fuel injector of each cylinder based on the lambda variation estimated during the DFSO. Cylinder air-fuel imbalance may result from an air-fuel ratio of one or more cylinders deviating from a desired or expected engine air-fuel ratio. A difference between the actual cylinder lambda and expected lambda may be determined for one or an average of lambda values and an injector fueling error may be learned based on the average lambda values. Learning the fueling error includes determining if the cylinder air-fuel ratio is leaner (e.g., excess oxygen) or richer (e.g., excess fuel) than expected and storing the learned error for future operation of the cylinder following termination of the DFSO. For example, if a lambda value of a selected cylinder is 2.1 and the expected lambda value is 1.9, then a rich air-fuel ratio variation may exist with a magnitude of 0.2. The magnitude may be learned and applied to future combustion in the cylinder subsequent to the DFSO such that a fuel injection may compensate the lambda variation of 0.2 (e.g., inject an amount of fuel in excess of the determined amount, the extra fuel proportional to the magnitude of 0.2) in the cylinder that exhibited the variation. After learning fuel error for each cylinder, the routine proceeds to 414.

At 414, the routine may include learning air-fuel imbalance for each cylinder based on one or more of the learned air error, learned fuel injector error, and a comparison of the air error to the fuel injector error. The air error may occur when a cylinder receives either less air or too much air than expected such as due to the specific geometry of the cylinders. The magnitude of the air error in the cylinder may depend on a position of the cylinder with respect to the air intake system. For example engine cylinders located near the air intake system may receive more air than cylinders located afar. Cylinder fuel error may occur due to a fuel injector injecting either more or less fuel than intended into a cylinder. Depending on the magnitude of the air error and fuel error in a given cylinder, a combination of the air and fuel error may lead to an overall air-fuel imbalance of the given cylinder from other cylinders. The cylinder imbalance may be a lean air-fuel imbalance if the air error is greater than the fuel error. Alternatively, the fuel error for the given cylinder may be greater than the air error, and may result in a rich air-fuel imbalance. In other cases, the air and fuel errors of the given cylinder may cancel out each other resulting in no air-fuel imbalance.

Next at 416, the routine judges if the air-fuel imbalance for a given cylinder is greater than a threshold imbalance estimate (e.g., higher than 0.2). If the answer is YES, the routine proceeds to 418. Otherwise, if the air-fuel imbalance is less than the threshold imbalance estimate, the routine exits.

At 418, the routine sets a diagnostic code by noting the identity of the imbalanced cylinders and the corresponding degree of imbalance. In one example, the diagnostic code may be removed only after the cylinder has been serviced by a technician. Further, while the code is set, operation of the imbalanced cylinder may be limited. For example, engine load may be limited. As a further example, upon setting the diagnostic code, the engine may enter an error mitigation mode wherein the error mitigation mode is an FMEM mode that reduces misdiagnosis of affected systems and reduces damage to engine components. In the error mitigation mode, an engine load (including air amount and total fuel mass) may be limited. The limiting may be based on the degree of imbalance identified, the engine load limited to a lower level when the degree of cylinder-to-cylinder imbalance is higher, and/or when a larger number of cylinders are imbalanced. After setting the diagnostic code, the routine proceeds to 420.

At 420, the routine adjusts cylinder operation of any cylinders exhibiting air-fuel imbalance as determined at 414. The adjusting may include adjusting amounts of fuel injected to engine cylinders via varying fuel injection amount. The fuel injection adjustments may be proportional to the air-fuel error as described at 412. The adjusting may further include injecting a greater amount of fuel or a lesser amount of fuel based on the type of cylinder air-fuel imbalance. For example, a given cylinder may show a rich air-fuel deviation at 414. The fuel adjustments may include injecting less fuel into the given cylinder. Alternatively, if the given cylinder shows a lean air fuel deviation, the fuel adjustments may include injecting more fuel into the given cylinder. By adjusting the amount of fuel injected into the imbalanced cylinders based on the air-fuel deviation, engine efficiency and operation may be improved while reducing emissions. The method 400 may exit after applying the adjustments corresponding to the learned air-fuel imbalance for each cylinder.

FIG. 5 shows an alternative method 500 for identifying cylinder air-fuel imbalance. In the example method 500, air-fuel imbalance is determined based on three different imbalance estimates, each estimate weighted by a confidence factor based on engine operating conditions. Therein the engine torque, exhaust gas oxygen sensor signals, and exhaust pressure signals are processed and stored following each combustion event. A different register-accumulator is used to store the average torque, lambda, and pressure for each individual cylinder by using the cylinder combustion spark event timing information. In this way, method 500 may reliably determine cylinder air-fuel imbalance at a broad range of operating conditions without interrupting engine operation. Method 500 will be described herein with reference to components and systems depicted in FIGS. 1-2, particularly, regarding engine 10, cylinder banks 15A and 15B, and controller 12. Method 500 may be carried out by the controller executing computer-readable media stored thereon. It should be understood that the method 500 may be applied to other engine systems of a different configuration without departing from the scope of this disclosure.

The method 500 proceeds to 502 based on a first operating condition. The first operating condition may include one or more of a medium engine load, idle condition, uniform exhaust mixing conditions and exhaust sensor is sufficiently warmed up. The routine may select an air-fuel ratio (AFR) corresponding to a deactivated cylinder of a selected VDE pattern (measured or estimated in method 300). The selected air-fuel ratio is normalized to a percent of an averaged air-fuel ratio (LAMavg), estimated when all engine cylinders are active.

Next at 504, a first confidence factor (c1) for the air-fuel ratio estimate for the deactivated cylinder of the selected VDE pattern is determined based on the first operating condition. The first confidence factor may reflect the reliability or accuracy of the air-fuel ratio estimate based on current engine conditions. The confidence factor may be set to a highest value of one (indicating greatest confidence), or may be set to a lowest value of zero if the cylinder imbalance estimate is unavailable or not reliable. A higher confidence factor indicates that the imbalance estimate is more reliable, while a lower confidence factor indicates that the imbalance estimate is less reliable. For example, the first confidence factor may be increased when mixing of the exhaust gas at the exhaust gas sensor is sufficient or above a threshold mixing level. In another example, the first confidence factor may be decreased during cold-start conditions when the exhaust gas sensor has not sufficiently warmed up, thus the estimate of air-fuel ratio may be unreliable. The first confidence factor may be different for each cylinder of the selected VDE pattern. As an example, exhaust sensor readings may be affected by location of a cylinder with respect to position of the exhaust sensor in such a way that flow from some cylinders may be detected at the exhaust sensor while flow from other cylinders may not be detected. Thus cylinders whose flow is detected at the exhaust sensor may be assigned higher confidence factors compared to cylinders whose flow is not detected.

If the vehicle is at the second operating condition, method 500 proceeds to 506. The second condition may be a medium load steady state condition, or an idle steady state condition. Further, the second operating condition maybe a variation in exhaust valve timing exceeding a threshold timing. Further still, the second operating condition maybe an average distance between a pressure sensor and the exhaust valve of combusting cylinders is less than a threshold distance. As such, the second operating condition may include any one of, or any combination of the above-mentioned operating conditions. The exhaust pressure ($P_n$) for each deactivated cylinder of the selected VDE pattern (estimated earlier in method 300) is normalized to a percent of the averaged exhaust pressure (Pavg) when all cylinders are active.

At 508, a second confidence factor for an exhaust pressure imbalance estimate for each deactivated cylinder of each selected VDE pattern is determined based on the second operating condition. The second confidence factor may be increased with less variation in valve timing, and decreased with greater variation in valve timing. The second confidence factor may further be set lower than a threshold value if the average distance between the pressure sensor and the exhaust valve of combusting cylinders is greater than a threshold distance. Further still, the second confidence factor may be set higher than a threshold value if the distance is smaller than the threshold distance.

If the vehicle is at the third operating condition, method 500 proceeds to 510. The third condition may be a cold start condition. For example, the cold-start condition may be determined when the exhaust gas temperature is lower than a threshold temperature and exhaust gas is not sufficiently mixed at the exhaust gas sensor. Further still, the third condition may be a lean engine operation. As such, the third operating condition may include any one of, or any combination of the above operating conditions. Upon meeting the third operating condition, a cylinder torque ($TQ_n$) measured or estimated in method 300 for each deactivated cylinder of each selected VDE pattern is normalized to a percent of an average cylinder torque (TQavg).

At 512, a third confidence factor (c3) for a cylinder torque imbalance estimate for each deactivated cylinder of the selected VDE pattern is determined based on the third operating condition. The third confidence factor may be decreased with a better mixing of exhaust gas at the exhaust gas sensor, and increased with insufficient mixing of exhaust gas at the exhaust gas sensor. The third confidence factor maybe increased with leaner air-fuel ratio, and decreased with richer air-fuel ratio. After estimating the normalized imbalance estimates and all confidence factors for each deactivated cylinder of each selected VDE pattern, method 500 may proceed to 514.

At 514, a comprehensive normalized parameter (CNP) for each deactivated cylinder of the selected VDE pattern is estimated based on confidence factors and normalized imbalance estimates. For example, the comprehensive normalized parameter for a deactivated cylinder (n) of the selected VDE pattern may be calculated as shown below:

$$CNP = c1\frac{LAM_n}{LAMavg} + c2\frac{P_n}{Pavg} + c3\frac{TQ_n}{TQavg} \quad \text{(Eq. 4)}$$

At 516, method 500 determines if the comprehensive normalized parameter for each deactivated cylinder of the selected VDE pattern is greater than a threshold parameter. The threshold parameter may be a threshold value or an averaged comprehensive normalized parameters determined when all cylinders are active. If the answer is NO (that is CNP is lower than the threshold parameter), method 500 proceeds to 518, where air-fuel imbalance in a deactivated cylinder is not detected and the routine exits.

Returning to 516, if the answer is YES (that is CNP is greater than the threshold parameter), method 500 proceeds to 520. At 520, each deactivated cylinder of the selected VDE pattern with air fuel imbalance is identified. The imbalanced cylinder may be identified based on a deviation of the comprehensive normalized parameter of the deactivated cylinder from the threshold parameter. The magnitude of the deviation may correspond to the magnitude of the air-fuel imbalance. For example, if the VDE pattern comprising four cylinders (e.g., cylinders A1-A4 and B1-B4 at FIG. 1) is selected for air-fuel imbalance learning. In one example during cold start conditions, cylinder A1 of the selected VDE pattern may be deactivated and the air-fuel error determined. If the first confidence factor is 0.2, second factor is 0.4 and third confidence factor is 0.4. In addition, if the normalized exhaust air-fuel ratio is 1.33 (0.8/0.6), normalized exhaust pressure is 0.86 (1.2/1.4) and normalized cylinder torque is 0.92 (2.4/2.6). The CNP is calculated as 0.98 but the threshold parameter is 0.8, then an air fuel error of 0.18 is determined for cylinder A1.

Method 500 then proceeds to 522 to update a diagnostic code containing information of imbalanced cylinders. For example, the diagnostic code for all imbalanced cylinders may be modified based on the deviation of the CNP from the threshold parameter determined at 516. In another example, the diagnostic code may be updated based on the difference between the current CNP deviation and a previous CNP deviation in the diagnostic code from the previous time the engine was operated. Further, an imbalance history of all cylinders may be updated. After updating the diagnostic code, method 500 may exit.

In one example, the engine torque, exhaust gas oxygen sensor signals, and exhaust pressure signals are processed and stored following each combustion event. A combined average of all cylinders is then calculated for each signal type. For each signal type, the individual cylinder values are normalized to a percent of the combined average to have up to three complete sets of normalized results for each cylinder. For each cylinder, the normalized results are weighted by a confidence factor (1.0 nominally) and added together to yield a comprehensive normalized result. The method with the greatest confidence is given the highest confidence factor (e.g., 1.0). The comprehensive normalized result for each cylinder is compared to the other cylinders. If the spread between the cylinders' torques exceeds a threshold, an imbalance is detected and determined. The cylinder(s) that are farthest (or exceed a threshold) from the combined mean of the cylinders' comprehensive normalized results are identified by setting a corresponding diagnostic code.

Turning to FIG. 6, an example graphical output of air-fuel imbalance in individual cylinders of a four engine cylinder is shown (e.g., an in-line engine with cylinders 1-4). The sequence of FIG. 6 may be provided by executing instructions in the system of FIGS. 1-2 according to the methods of FIGS. 3-4. The individual cylinders of the engine are plotted on the x-axis while air error, fuel error and air-fuel imbalance are plotted on the y-axis. The air error, fuel injector error and air-fuel imbalance values are determined for each cylinder when DFSO conditions are met as explained at FIG. 4. Air error values for cylinders 1-4 are illustrated at graph 602, the zero air error is represented by line 604. The fuel error for each cylinder is plotted on graph 606 and air-fuel imbalance for each cylinder is plotted on graph 610. Lines 608 and 612 represent zero fuel error and zero air-fuel imbalance, respectively. While the depicted example shows zero errors are 604, 608, and 612 in alternate examples, they may represent a combined mean value of that parameter based on the estimate of that parameter for all cylinders, and the solid circles depict deviations from the combined mean.

Referring to graph 602, air error values are depicted for each cylinder. As shown, cylinder 1 has a relatively higher air error value, while cylinders 2 and 3 have relatively lower air error values. In particular, cylinder 1 deviates the most from the mean. Cylinders 1 and 3 are receiving more air than expected but cylinder 1 is receiving more air compared to cylinder 3. Cylinder 2 is receiving less air than expected while cylinder 4 shows no air error (604) since the cylinder is receiving the expected amount of air. For example, cylinders 1-3 may show air error values of 0.5, 0.2, 0.1, respectively while cylinder 4 shows no air error. The air error of 0.5 in cylinder 1 shows that the cylinder is receiving a larger amount of air than is expected. Cylinder 2 shows an air error of 0.2, indicating that the cylinder is receiving a lower amount of air than is expected. Cylinder 3 shows an air error of 0.1, indicating that the cylinder is receiving a larger amount of air than is expected but the amount of air received by cylinder 3 is less compared to the amount received by cylinder 1.

Next, graph 606 shows fuel error values for cylinders 1-4. As illustrated, cylinders 1-3 show fuel errors while cylinder 4 shows no fuel error (608). Cylinders 1 and 3 are receiving a lower amount of fuel than expected while cylinder 2 is receiving a higher amount of fuel than expected. Since cylinder 4 shows no fuel error, the cylinder is receiving the expected amount of the fuel. For example cylinders 1-3 may show fuel error values of 0.2, 0.15, 0.1, respectively while cylinder 4 shows no fuel error.

Next, graph 610 shows air-fuel imbalance values for cylinders 1-4. As shown, cylinder 1 has a relatively higher air-fuel imbalance, while cylinder 2 has a relatively lower air-fuel imbalance. Cylinders 3-4 show no air-fuel imbalance. Cylinder 1 shows a lean air-fuel deviation while cylinder 2 shows a rich air-fuel variation. Since cylinder 1 is receiving a larger amount of air than is expected but less fuel, a large lean air-fuel deviation may be detected. Cylinder 2 receives a lower amount of air than is expected but a larger amount of fuel, therefore a rich air-fuel deviation may be observed. The air and fuel errors in cylinder 3 cancel out, resulting in no air-fuel imbalance (612) in the cylinder. Since cylinder 4 has no air and fuel errors, no air-fuel imbalance (612) is detected.

The air error, fuel error and air-fuel imbalance in each imbalanced cylinder is noted and stored in the diagnostic code. A controller may adjust cylinder operation of any cylinders exhibiting air-fuel imbalance as determined above. The adjusting may include adjusting amounts of fuel injected to the imbalanced cylinders via varying fuel injection timing, such as by advancing or retarding fuel injection timing. The fuel injection timing adjustments may be proportional to the air-fuel error determined. The adjusting may further include injecting a greater amount of fuel or a lesser amount of fuel based on the type of cylinder air-fuel imbalance. For example, cylinder 1 show a lean air-fuel deviation while cylinder 2 shows a rich air-fuel deviation. The fuel adjustments may include injecting more fuel into cylinder 1 but less fuel into cylinder 2 to bring the air-fuel ratio of both cylinders to a stoichiometric value. By adjusting the amount of fuel injected into the imbalance cylinders based on the air and fuel errors and air-fuel imbalance estimate, engine efficiency and operation may be improved while reducing emissions.

In this way, air-fuel imbalance between cylinders can be reliably and robustly determined without driving an air-fuel ratio excursion and without relying on expensive sensors. In addition, imbalance may be determined for cylinders independent of their geometry. By improving the robustness of imbalance detection and reducing both false and missed detections, warranty costs are reduced.

In one example, a method for an engine comprises: during a cylinder deactivation event, sequentially deactivating each cylinder of a cylinder group including two or more cylinders; estimating a lambda deviation for each cylinder following the sequential deactivation of each cylinder of the cylinder group; and learning an air error for each cylinder based on the estimated lambda deviation. The preceding example may additionally or optionally further comprise, differentiating the air error for each cylinder from fuel injector error for fuel injectors of each cylinder of the cylinder group. Any or all of the preceding examples, additionally or optionally further comprise, during a deceleration fuel shut-off (DFSO) event, sequentially firing each cylinder of the cylinder group with a fuel pulse width selected to provide an expected lambda deviation, and learning the fuel injector error for each cylinder of the cylinder based on an actual lambda deviation relative to the expected air-fuel deviation. Any or all of the preceding examples, additionally or optionally further comprise, indicating an air-fuel ratio imbalance for each cylinder based on the learned air error for said cylinder. In any or all of the preceding examples, additionally or optionally, estimating the lambda deviation includes estimating a deviation from an average lambda with all cylinders firing before the cylinder deactivation event. In any or all of the preceding examples, additionally or optionally, the cylinder deactivation event is responsive to a drop in driver demand, and wherein a number and identify of cylinders in the cylinder group selected for sequential deactivation is based on the drop in driver demand. In any or all of the preceding examples, additionally or optionally, an order of the sequentially deactivating is based on each of a firing order of each cylinder of the cylinder group and a duration elapsed since a last air error diagnostic for each cylinder of the cylinder group. In any or all of the preceding examples, additionally or optionally, the indicating includes indicating an air-fuel imbalance for a given cylinder in response to the learned air error for the given cylinder being higher than a threshold error.

Furthermore, in any or all of the preceding examples, additionally or optionally, the learned error is a first error, the method further comprising: during engine idling conditions, sequentially deactivating each cylinder of the cylinder group, and learning a second air error for each cylinder based on the estimated lambda deviation; during engine load higher than a threshold load and with a torque converter locked, sequentially deactivating each cylinder of the cylinder group, and learning a third air error for each cylinder based on the estimated lambda deviation; and indicating the air-fuel ratio imbalance for each cylinder based on each of the first, second, and third air error.

Any or all of the preceding examples, additionally or optionally further comprise, in response to the indicating of air-fuel imbalance in a first cylinder of the cylinder group, after reactivating the cylinder group, adjusting fueling of the first cylinder based on the learned air error for the first cylinder, and further adjusting fueling of remaining cylinders of the cylinder group based on the learned air error to maintain air-fuel ratio at or around stoichiometry. Any or all of the preceding examples, additionally or optionally further comprise, learning a torque error for each cylinder of the cylinder group based on one or more of crankshaft accelerations and exhaust pressure pulsations during the sequentially deactivating, and indicating the air-fuel ratio imbalance based on the learned air error relative to the learned torque error. In any or all of the preceding examples, additionally or optionally, the cylinder group is a first cylinder group and the lambda deviation is estimated based on an output of a first common exhaust gas sensor selectively receiving exhaust from each cylinder of the first cylinder group, wherein the engine includes a second, different cylinder group and a second common exhaust gas sensor selectively receiving exhaust from each cylinder of the second cylinder group, the method further comprising, differentiating an error of the first common exhaust gas sensor from an error of the second common exhaust gas sensor based on an air-fuel ratio imbalance of the first cylinder group relative to an air-fuel ratio imbalance of the second cylinder group.

In another example, a method for an engine may comprise, estimating a first lambda with all cylinders firing; selectively deactivating a first cylinder and estimating a second lambda; then, reactivating the first cylinder while selectively deactivating a second cylinder and estimating a third lambda; learning a first air error for the first cylinder based on the second lambda relative to the first lambda; learning a second air error for the second cylinder based on the third lambda relative to the first lambda; and upon reactivating the first and second cylinder, adjusting fueling of each of the first and the second cylinder based on each of the first and second air error to operate the engine at or around stoichiometry. The preceding example may additionally or optionally further comprise, estimating a maximum lean lambda with all cylinders deactivated; selectively fueling the first cylinder and learning a fuel error for the first cylinder based on actual change in lambda relative to an expected change in lambda; then, deactivating the first cylinder while selectively fueling the second cylinder and learning a fuel error for the second cylinder based on the actual change in lambda relative to the expected change in lambda; and upon reactivating the first and second cylinder, adjusting fueling of the first cylinder based on the first fuel error and the fueling of the second cylinder based on the second fuel error to operate the engine at or around stoichiometry. In any or all of the preceding examples, additionally or optionally, the selectively deactivating is in response to a drop in driver torque demand, and wherein all cylinders are deactivated in response to deceleration fuel shut-off conditions. Any or all of the preceding examples, additionally or optionally further comprise, differentiating air-fuel sensor errors for a common air-fuel sensor coupled to each of the first and the second cylinder.

Another example engine system comprises: an engine cylinder group including two or more cylinders; selectively deactivatable fuel injectors coupled to each cylinder of the cylinder group; an exhaust air-fuel ratio sensor receiving exhaust from each cylinder of the cylinder group; a controller with computer readable instructions stored on non-transitory memory for: sequentially deactivating each cylinder of the cylinder group responsive to cylinder deactivation conditions and learning an air error for each cylinder of the cylinder group based on a first lambda deviation estimated at the exhaust air-fuel ratio sensor following the sequential deactivation; sequentially fueling each cylinder of the cylinder group responsive to deceleration fuel shut-off conditions and learning a fuel injector error for each cylinder of the cylinder group based on a second lambda deviation estimated at the exhaust air-fuel ratio sensor following the sequential fueling; and indicating cylinder air-fuel imbalance based on the learned air error relative to the learned fuel injector error. In any or all of the preceding examples, additionally or optionally, the controller includes further instructions for: adjusting fueling of each cylinder of the cylinder group during subsequent engine operation with all cylinders firing based on each of the learned air error, the learned fuel injector error, and the cylinder air-fuel imbalance. In any or all of the preceding examples, additionally or optionally, the controller includes further instructions for: in response to the cylinder air-fuel imbalance for a cylinder being higher than a threshold, setting a diagnostic code and entering an error mitigation mode, wherein the error mitigation mode is an FMEM mode that will prevent misdiagnosis of affected systems and prevent damage to engine components. In any or all of the preceding examples, additionally or optionally, an engine load (including air amount and total fuel mass) is limited in the error mitigation mode. In any or all of the preceding examples, additionally or optionally, the controller includes further instructions for: learning an offset of the exhaust air-fuel ratio sensor based on the learned air error relative to the learned fuel injector error.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during a cylinder deactivation event, sequentially deactivating each cylinder of a cylinder group including two or more cylinders;

estimating a lambda deviation for each cylinder following the sequential deactivation of each cylinder of the cylinder group;

learning an air error for each cylinder based on the estimated lambda deviation; and indicating an air-fuel ratio imbalance for each cylinder based on the learned air error for said cylinder.

2. The method of claim 1, further comprising differentiating the air error for each cylinder from fuel injector error for fuel injectors of each cylinder of the cylinder group.

3. The method of claim 2, further comprising, during a deceleration fuel shut-off (DFSO) event, sequentially firing each cylinder of the cylinder group with a fuel pulse width selected to provide an expected lambda deviation, and learning the fuel injector error for each cylinder of the cylinder group based on an actual lambda deviation relative to the expected lambda deviation.

4. The method of claim 1, wherein estimating the lambda deviation includes estimating a deviation from an average lambda with all cylinders firing before the cylinder deactivation event.

5. The method of claim 1, wherein the cylinder deactivation event is responsive to a drop in driver demand, and wherein a number and identity of cylinders in the cylinder group selected for sequential deactivation is based on the drop in driver demand.

6. The method of claim 5, wherein an order of the sequentially deactivating is based on each of a firing order of each cylinder of the cylinder group and a duration elapsed since a last air error diagnostic for each cylinder of the cylinder group.

7. The method of claim 1, wherein the indicating includes indicating an air-fuel imbalance for a given cylinder in response to the learned air error for the given cylinder being higher than a threshold error.

8. The method of claim 1, wherein the learned error is a first error, the method further comprising:

during engine idling conditions, sequentially deactivating each cylinder of the cylinder group, and learning a second air error for each cylinder based on the estimated lambda deviation;

during engine load higher than a threshold load and with a torque converter locked, sequentially deactivating each cylinder of the cylinder group, and learning a third air error for each cylinder based on the estimated lambda deviation; and indicating the air-fuel ratio imbalance for each cylinder based on each of the first, second, and third air error.

9. The method of claim 1, further comprising, in response to the indicating of air-fuel imbalance in a first cylinder of the cylinder group, after reactivating the cylinder group, adjusting fueling of the first cylinder based on the learned air error for the first cylinder, and further adjusting fueling of remaining cylinders of the cylinder group based on the learned air error to maintain air-fuel ratio at or around stoichiometry.

10. The method of claim 1, further comprising learning a torque error for each cylinder of the cylinder group based on one or more of crankshaft accelerations and exhaust pressure pulsations during the sequentially deactivating, and indicating the air-fuel ratio imbalance based on the learned air error relative to the learned torque error.

11. The method of claim 1, wherein the cylinder group is a first cylinder group and the lambda deviation is estimated based on an output of a first common exhaust gas sensor selectively receiving exhaust from each cylinder of the first cylinder group, wherein the engine includes a second, different cylinder group and a second common exhaust gas sensor selectively receiving exhaust from each cylinder of the second cylinder group, the method further comprising differentiating an error of the first common exhaust gas sensor from an error of the second common exhaust gas sensor based on an air-fuel ratio imbalance of the first cylinder group relative to an air-fuel ratio imbalance of the second cylinder group, and differentiating the air error from an exhaust sensor error.

12. A method for an engine, comprising:

estimating a first lambda with all cylinders firing;

selectively deactivating a first cylinder and estimating a second lambda;

then, reactivating the first cylinder while selectively deactivating a second cylinder and estimating a third lambda;

learning a first air error for the first cylinder based on the second lambda relative to the first lambda;

learning a second air error for the second cylinder based on the third lambda relative to the first lambda;

determining an air-fuel ratio imbalance based on one or more of the learned air errors; and upon reactivating the first and the second cylinder, adjusting fueling of each of the first and the second cylinder based on each of the first and the second air error to operate the engine at or around stoichiometry.

13. The method of claim 12, further comprising, estimating a maximum lean lambda with all cylinders deactivated;

selectively fueling the first cylinder and learning a fuel error for the first cylinder based on actual change in lambda relative to an expected change in lambda;

then, deactivating the first cylinder while selectively fueling the second cylinder and learning a fuel error for the second cylinder based on the actual change in lambda relative to the expected change in lambda; and upon reactivating the first and the second cylinder, adjusting fueling of the first cylinder based on the first fuel error and the fueling of the second cylinder based on the second fuel error to operate the engine at or around stoichiometry.

14. The method of claim 13, wherein the selectively deactivating is in response to a drop in driver torque demand, and wherein all cylinders are deactivated in response to deceleration fuel shut-off conditions.

15. The method of claim 13, further comprising differentiating air-fuel sensor errors for a common air-fuel sensor coupled to each of the first and the second cylinder.

16. An engine system, comprising:

an engine cylinder group including two or more cylinders;

selectively deactivatable fuel injectors coupled to each cylinder of the cylinder group;

an exhaust air-fuel ratio sensor receiving exhaust from each cylinder of the cylinder group;

a controller with computer readable instructions stored on non-transitory memory for:

sequentially deactivating each cylinder of the cylinder group responsive to cylinder deactivation conditions and learning an air error for each cylinder of the cylinder group based on a first lambda deviation estimated at the exhaust air-fuel ratio sensor following the sequential deactivation;

sequentially fueling each cylinder of the cylinder group responsive to deceleration fuel shut-off conditions and learning a fuel injector error for each cylinder of the cylinder group based on a second lambda deviation estimated at the exhaust air-fuel ratio sensor following the sequential fueling; and indicating cylinder air-fuel imbalance based on the learned air error relative to the learned fuel injector error.

17. The system of claim 16, wherein the controller includes further instructions for: adjusting fueling of each cylinder of the cylinder group during subsequent engine operation with all cylinders firing based on each of the learned air error, the learned fuel injector error, and the cylinder air-fuel imbalance.

18. The system of claim 16, wherein the controller includes further instructions for: in response to the cylinder air-fuel imbalance for a cylinder being higher than a threshold, setting a diagnostic code and entering an error mitigation mode.

19. The system of claim 16, wherein the controller includes further instructions for: learning an offset of the exhaust air-fuel ratio sensor based on the learned air error relative to the learned fuel injector error.

* * * * *